United States Patent [19]

Cole et al.

[11] 4,115,749

[45] Sep. 19, 1978

[54] MICROWAVE HYBRID PHASE MATCHING SPACER

[75] Inventors: Sidney Michael Cole, Waverly; Paul Lee Clouser, Vestal, both of N.Y.

[73] Assignee: The United States of America as represented by the Secretary of the Air Force, Washington, D.C.

[21] Appl. No.: 790,778

[22] Filed: Apr. 25, 1977

[51] Int. Cl.[2] ..... H01P 1/18

[52] U.S. Cl. ..... 333/31 R; 333/84 M; 333/97 R

[58] Field of Search ..... 333/21 R, 31 R, 33–35, 333/84 M, 97 R, 33

[56] References Cited

U.S. PATENT DOCUMENTS

| | | | |
|---|---|---|---|
| 3,553,607 | 1/1971 | Lehrfeld | 333/34 |
| 3,686,624 | 8/1972 | Napoli et al. | 333/33 UX |
| 3,757,272 | 9/1973 | Laramee et al. | 333/84 M X |
| 3,825,861 | 7/1974 | O'Donnell | 333/33 |
| 3,852,690 | 12/1974 | Telfer | 333/84 M |

*Primary Examiner*—Paul L. Gensler
*Attorney, Agent, or Firm*—Joseph E. Rusz; Henry S. Miller

[57] ABSTRACT

In a hybrid connector for microwave devices between coaxial and microstrip application, the utilization of a calibrated, shaped, dielectric spacer in the connection for phase matching.

1 Claim, 2 Drawing Figures

MICROWAVE HYBRID PHASE MATCHING SPACER

STATEMENT OF GOVERNMENT INTEREST

The invention described herein may be manufactured and used by or for the Government for governmental purposes without the payment of any royalty thereon.

BACKGROUND OF THE INVENTION

This invention relates generally to microwave transmission devices and more particularly to a means for promoting phasematching between dissimilar transmission devices.

Coaxial cables have been long known and accepted as a means of transmitting microwave energy from one location to to another. These cables are frequently utilized for connecting together various pieces of apparatus within a system. In such applications, the cables are of varying lengths and as a result, problems inevitably arise concerning phase matching.

Various solutions have been proposed for phase error correction. These methods have been successful where cables have been connected to like devices i.e. other cables. However, where connections arise between dissimilar devices for example, the coaxial cable and a microstrip, the problem of phase error correction has not been adequately solved.

SUMMARY OF THE INVENTION

The invention relates to a means for phase error correction in hybrid or dissimilar connections.

Microstrip circuits are connected to other devices and apparatus by coaxial cables. In order to compensate for the various lengths of these cables, it has been found that an appropriately shaped spacer, of proper dimensions and required impedance will provide phase error correction.

The invention places a spacer inside a hybrid box where it has proven to exceed in voltage standing wave ratio, linearity and adjustment range, all other methods of providing phase error correction.

The phase matching is accomplished by inserting a spacer of known impedance into the hybrid box where it effectively lengthens or shortens the coaxial cable. The spacer may be in a disk shape having a metal conductive outer ring and an inner member of a dielectric material.

If the spacer is placed between a female coaxial conductor and the microstrip substrate, it will effectively accomplish its intended goal of phase error correction.

It is therefore an object of the invention to provide a new and improved microwave hybrid phase matching spacer.

It is another object of the invention to provide a new and improved microwave hybrid phase matching space that is low in cost and easily assembled.

It is a further object of the invention to provide a new and improved microwave hybrid phase matching spacer that includes greater linearity and adjustment range than any other known similar device.

It is still another object of the invention to provide a new and improved microwave hybrid phase matching spacer whose voltage standing wave ratio exceeds that of similar known devices.

It is still a further object of the invention to provide a new and improved microwave hybrid phase matching spacer that is contained within the hybrid box.

These and other advantages, features and objects of the invention will become more apparent from the following description taken in connection with the illustrative embodiment in the accompanying drawings.

DESCRIPTION OF THE PREFERRED EMBODIMENT

Figure 1:
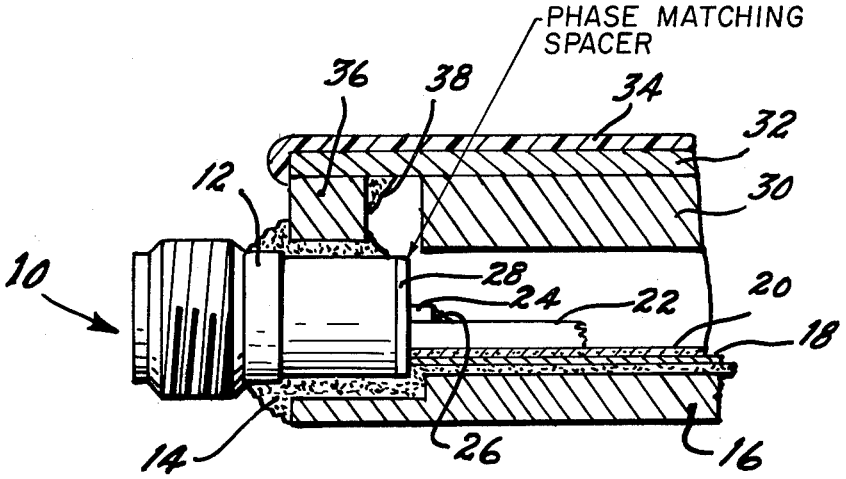
FIG. 1 is a side elevation view, partly in section of a hybrid connector, including the invention.

Referring now to FIG. 1, there is shown a typical female coaxial connector generally at 10. The connector outer casing 12 is soldered (14) to a chassis 16, made of Kovar or other suitable material. Soldered (14) to the chassis base is a conductive ground plane 18 formed of copper or another conductive material. A layer of dielectric material 20 overlies ground plane 18 which has printed circuit 22 affixed thereto. The printed circuit may be an etched gold pattern and arranged with layers 18 and 20 in conventional stripline circuit manner.

Pin 24 protrudes from connector 10 and rests on circuit 22. Solder 26 affixes the pin to the circuit. Member 28 is a circular spacer having known dimensions and a known impedance. Phase adjustments can be calculated or tested before the actual mounting of member 28 over pin 24 and between casing 12 and circuit 22.

The remainder of the package consists of a layer of radiation absorbing material 30 which is affixed in a conventional manner to cover 32. A stiffener plate 34 is bonded with a polymer adhesive to cover 32 for added strength. Spacer block 36 is welded to cover 32 at 38 and soldered to connector 10 to form a hermetic seal around the device.

Figure 2:
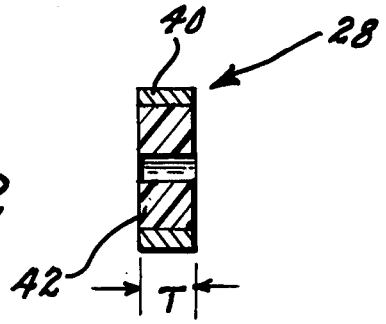
FIG. 2 is a cross-sectional view of the invention.

FIG. 2 shows the spacer generally at 28, in cross section. A metal ring 40 gives shape to the spacer, and provides improved impedance matching and enhanced phase and amplitude characteristics. The inner member 42 is a dielectric and adds the required phase length to the circuit. The thickness T is variable and depends on the phase change required. Phase matching is accomplished by varying the impedance of the material, by varying the thickness of the material or any combination of these.

Additional connectors (not shown) similar to connector 12 are mounted to box 16 and connected to the microstrip circuit. The connectors are arrayed in predetermined pairs and a spacer 10 is associated with one of the connectors of the pair to effect the phase matching between the connectors of the particular pair.

Although the invention has been described with reference to a particular embodiment, it will be understood to those skilled in the art that the invention is capable of a variety of alternative embodiments within the spirit and scope of the appended claims.

What is claimed is:

1. A microwave hybrid means for connecting coaxial and microstrip circuits and providing a phase matched connection comprising:

a box adapted to contain microstrip circuit boards;

a microstrip circuit board mounted within the box;

a cylindrically shaped female coaxial connector soldered to the box having a threaded member extending outwardly from the box and a pin positioned along the central logituding axis of the connector extending inwardly from the box, and said pin extending sufficiently to contact said microstrip circuit;

and a spacing means adapted to provide a sliding fit over said pin and mounted in juxtaposition with one end of said female coaxial connector and abutting said microstrip circuit, said spacing means further including a metal, ring shaped outer member and an inner member of dielectric material and having a thickness and dielectric constant selected for correcting phase error between said female coaxial connector and said microstrip circuit board.

* * * * *